US007185435B1

(12) United States Patent
Tseng

(10) Patent No.: US 7,185,435 B1
(45) Date of Patent: Mar. 6, 2007

(54) UTILITY KNIFE WITH DUAL BLADES

(75) Inventor: Yi Chuan Tseng, Taichung Hsien (TW)

(73) Assignee: AWI Acquisition Company, Sylmar, CA (US)

( * ) Notice: Subject to any disclaimer, the term of this patent is extended or adjusted under 35 U.S.C. 154(b) by 0 days.

(21) Appl. No.: 11/270,698

(22) Filed: Nov. 9, 2005

(51) Int. Cl.
*B26B 3/06* (2006.01)
*B26B 29/02* (2006.01)

(52) U.S. Cl. ..... 30/152; 30/162; 30/287; 83/578

(58) Field of Classification Search ..... 30/162, 30/152, 286, 287, 289; 83/578
See application file for complete search history.

(56) References Cited

U.S. PATENT DOCUMENTS 5,048,188 A * 9/1991 Wolff ..... 30/288
5,325,594 A * 7/1994 Szafranski ..... 30/294
5,425,295 A * 6/1995 Peters et al. ..... 83/522.24
5,943,780 A * 8/1999 McIlhatten ..... 30/294
5,943,929 A 8/1999 Sebesta
5,960,544 A * 10/1999 Beyers ..... 30/125
6,154,967 A * 12/2000 Rogala ..... 30/292
6,848,185 B2 * 2/2005 Tebo ..... 30/162
6,951,055 B1 * 10/2005 Collins ..... 30/162

* cited by examiner

*Primary Examiner*—Kenneth E. Peterson
*Assistant Examiner*—Sean Michalski
(74) *Attorney, Agent, or Firm*—Jack C Munro; Sandy Lipkin

(57) ABSTRACT

A utility knife that includes a pair of blades mounted on a blade holder. One blade is to be extendable from the housing of the utility knife adjacent the fore end of the utility knife with the other blade to be extendable from the housing to be usable for adjacent the aft end of the housing. The blade at the fore end of the housing is to be usable by the user exerting a pulling action toward the user with the blade at the aft end of the housing to be usable by the user exerting a pushing action against the housing.

14 Claims, 4 Drawing Sheets

UTILITY KNIFE WITH DUAL BLADES

BACKGROUND OF THE INVENTION

1. Field of the Invention

The field of this invention relates to knifes and more particularly to a utility knife that is commonly used by homeowners and building trade individuals.

2. Description of the Related Art

Utility knives have long been known. A typical utility knife has an elongated body with there being a slot located within the fore end of the elongated body. There is a slidable button mounted on the housing and the user is to move the slidable button to cause a blade to be extended from the body. The utility knife is then to be used in a motion pulling the knife across a workpiece in the direction of the user to perform a cut.

People in the building trade business, such as contractors and carpenters, utilize utility knives frequently. Pulling of a utility knife toward the user can, in some instances, be a dangerous situation. If the knife slips or becomes free of the workpiece, the knife can actually be pulled by the user directly into the user's body causing injury to the user. The use of a utility knife, in the past, has only been by a pulling motion. In some instances, it would be desirable to utilize a utility knife with a pushing action, which in some situations would be much safer because the knife is being pushed away from the user's body, and if it slips free of the workpiece and is rapidly projected outward it will not come into contact with the user's body.

Also, if performing of cuts on a workpiece, the making of a cut only by a pulling action is limiting. For example, if a cut is being made on a four foot by eight foot panel of sheetrock, a certain cut may be easier to perform by executing of a pushing action as opposed to a pulling action. It would be desirable to design a utility knife that could utilize both a pushing action or pulling action.

Reference is to be had to U.S. Pat. No. 5,943,929 by Wayne Anthony Sebesta, in which there is shown a utility knife that is capable of being used by both pulling and pushing of the housing of the knife. The blade of this knife comprises a single blade and this blade is mounted so that it can be pivoted to different angular positions. This will permit the knife blade to be used with both a pulling force and a pushing force. A knob is mounted on the housing of this prior art utility knife and by turning of the knob the blade will be caused to extend in either a fore position or an aft position.

This prior art utility knife construction has a disadvantage in that it is constructed quite complexly and it utilizes only a single blade. If the blade breaks, it is a difficult procedure in order to replace the blade. It would be desirable to utilize a utility knife that had two blades that could be placed in the operating position so that if one blade breaks and the operator chooses to continue with the cutting procedure that the operator only needs to turn the utility knife one hundred-eighty degrees and cause a second blade to extend and then can proceed on with the cutting action.

SUMMARY OF THE INVENTION

A first basic embodiment of the present invention is directed to a utility knife which has a dome-shaped housing having a top portion, two side portions, a front portion, a rear portion and an internal chamber. The housing has a footplate and the footplate has a fore end and an aft end. A first slot and a second slot are formed in the footplate with the first slot located directly adjacent the fore end and the second slot located directly adjacent the aft end. Both the first and second slots are located along the longitudinal middle of the footplate of the housing. The footplate is then able to be adapted to be placed against a workpiece that is to be cut. A blade holder is mounted within the internal chamber that is capable of housing a plurality of blades. The blade holder is pivotable relative to the housing between a fore position and an aft position. A first blade and a second blade are mounted on the blade holder. With the blade holder in the fore position, the first blade extends exteriorly of the internal chamber through the first slot located along the longitudinal middle of the footplate of the housing. With the blade holder in the aft position, the second blade extends exteriorly of the internal chamber through the second slot located along the longitudinal middle of the footplate of the housing. An actuator is connected to the blade holder on the front end of the housing with the actuator extending exteriorly of the housing. The actuator is contactable manually to cause movement of the blade holder between the fore position and the aft position. There is an entry means to the inner chamber located on the rear end of the housing allowing access to the plurality of house blades. There are a pair of push buttons located on the front end of the housing that are equipped with blade release mechanisms.

A further embodiment of the present invention is where the first basic embodiment is modified by defining that the footplate is substantially planar and has slightly upturned ends on the fore and aft ends.

A further embodiment of the present invention is where the first basic embodiment is modified by defining that the housing includes a centrally located semicircular post with the blade holder to be pivotable about this semicircular post.

A further embodiment of the present invention is where the first basic embodiment is modified by defining that the blade holder is locatable in an intermediate or neutral position which is located in between the fore position and the aft position, and when in the intermediate position no blade is extending from the housing.

A further embodiment of the present invention is where the first basic embodiment is modified by defining that the actuator comprises a slidable button.

A further embodiment of the present invention is where the first basic embodiment is modified by defining that the actuator is lockable in any one of a plurality of different positions to produce varying amounts of extension of the blades relative to the housing.

A further embodiment of the present invention is where the first basic embodiment is modified by defining that there is a blade release mechanism mounted on the housing with the blade release mechanism being activatable to cause each blade to be disengaged from the housing in order to permit quick replacement with a new blade.

A further embodiment of the present invention is where the first basic embodiment is modified to where the actuator includes a latch plate that is to be usable to be engaged when the actuator is in the intermediate or neutral position where neither the first blade or the second blade is extended from the housing.

A further embodiment of the present invention is where the second basic embodiment is modified by defining only one blade of the blades is to be extended at a time.

A further embodiment of the present invention is where the second basic embodiment is modified by defining that the blade holder is pivotally movable relative to the housing between a fore position that will cause one blade of the blades to be extended and in an aft position that will cause another blade of the blades to be extended.

A further embodiment of the present invention is where the second basic embodiment is modified by defining that the blade holder can be located in an intermediate or neutral position where no blade is extended.

A further embodiment of the present invention is where the second basic embodiment is modified by defining that there is an actuator that is accessible for manual operation located exteriorly of the housing to cause the blade holder to be pivoted.

A further embodiment of the present invention is where the second basic embodiment is modified by defining that the blade holder is lockable in any one of a plurality of different positions that will cause the blades to be extended various distances from the housing.

A further embodiment of the present invention is where the second basic embodiment is modified by defining that there is included a blade release mechanism mounted on the housing with the blade release mechanism being activatable to cause each blade to be disengaged from the housing in order to permit replacement with a new blade.

A further embodiment of the present invention is where a previous embodiment by defining that the actuator includes a latch plate which said latch plate is to be engaged only when the actuator is in a neutral or intermediate position where neither blade of the blades is extended from the housing.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
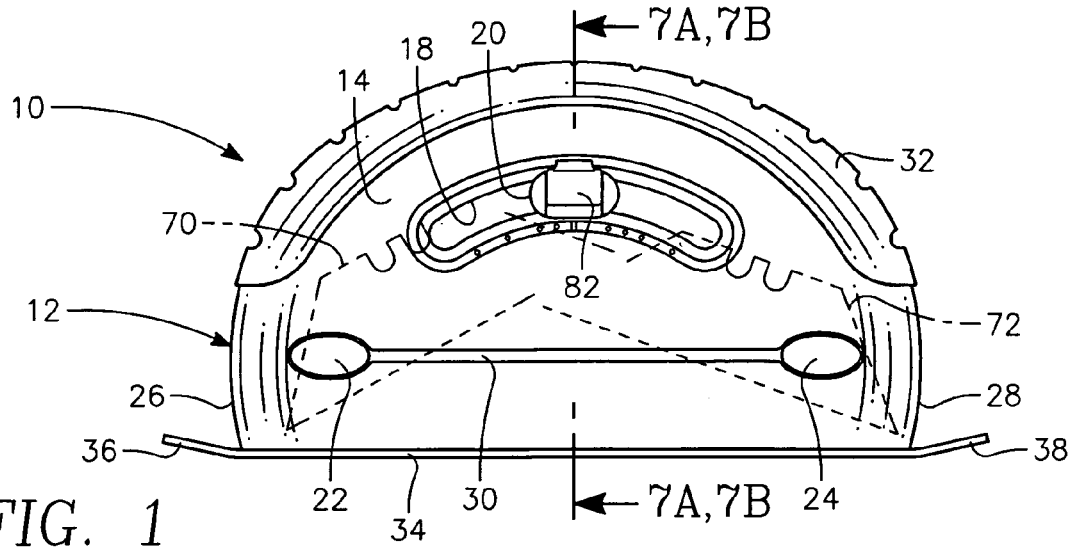
FIG. 1 is a front side elevational view of the housing of the utility knife of the present invention showing the slidable button actuator which is used to extend the cutting blades of the utility knife.
Figure 2:
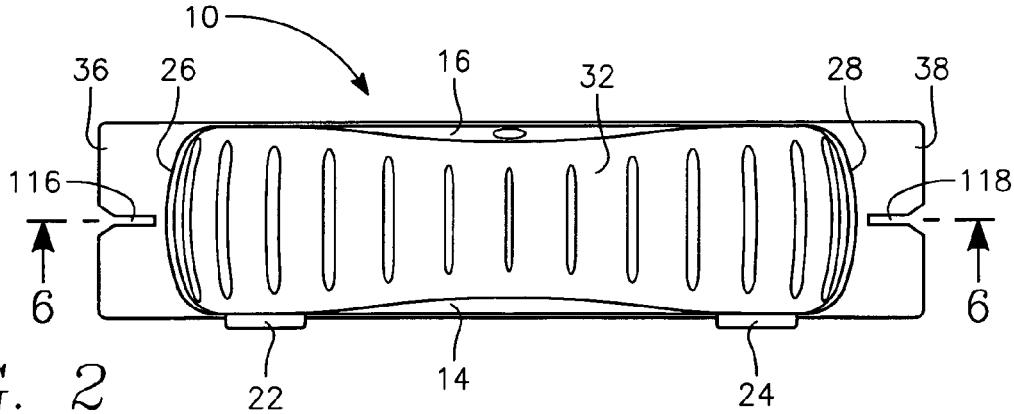
FIG. 2 is a top plan view of the housing of the utility knife.
Figure 3:
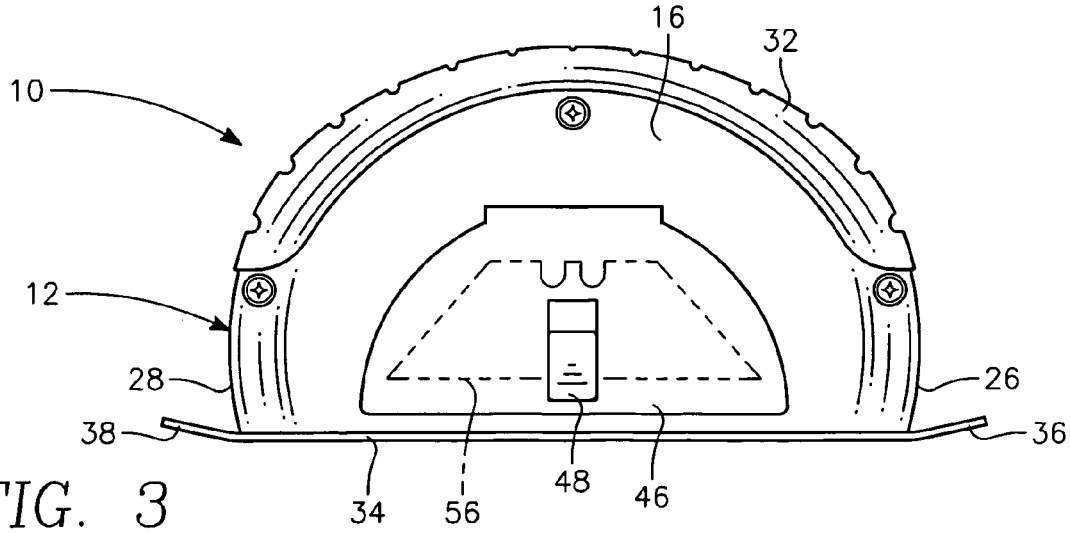
FIG. 3 is a rear side elevational view of the housing of the utility knife of the present invention.
Figure 4:
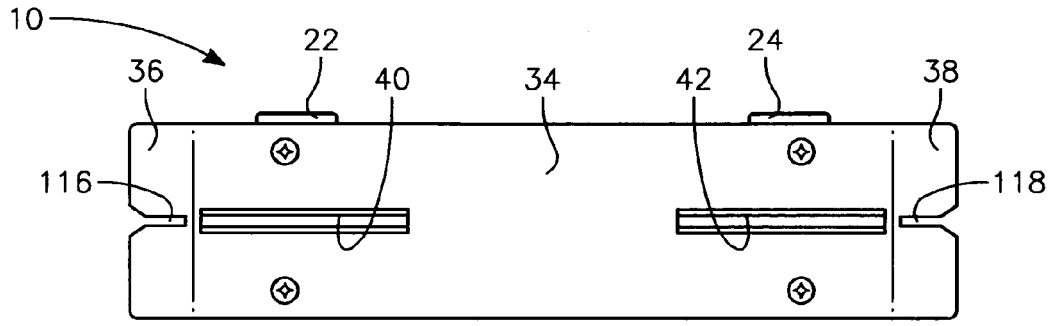
FIG. 4 is a bottom plan view of the utility knife of the present invention.

Referring particularly to the drawings, there is shown in FIGS. 1–4 the exterior of the utility knife 10 of this invention. The utility knife 10 has a dome-shaped housing 12 which has a front side 14 and a rear side 16. The front side 14 includes an arcuate slot 18. Mounted within the arcuate slot 18 is a slidable button 20. Also mounted within the front side 14 are a pair of spaced apart push buttons 22 and 24. The operation and construction of push buttons 22 and 24 are basically identical. The push button 22 is located directly adjacent the fore end 26 of the housing 12 and push button 24 is located directly adjacent the aft end 28 of the housing 12. Interconnecting the push buttons 22 and 24 is a longitudinal groove 30. The function of the groove 30 is strictly for ornamentation.

The dome shape of the housing 12 is to be covered with a resilient material, such as a rubber or rubberized plastic 32. The palm area of the user's hand is to be in contact with the rubber layer 32 with a non-slip comfortable surface being provided to the user when using of the utility knife 10 of this invention. The bottom surface of the housing 12 includes a footplate 34 which has upturned ends 36 and 38. Upturned ends 36 and 38 of footplate 34 are so as to facilitate engagement with a workpiece, which is not shown, so that the footpad 34 will not tend to dig into the workpiece. The footplate 34 is substantially planar and includes a first slot 40 located directly adjacent the fore end 26 and a second slot 42 located directly adjacent the aft end 28. The slots 40 and 42 are basically of the same width and the same length. Each of the slots 40 and 42 are located along the longitudinal middle of the housing 12. Each of the slots 40 and 42 communicate with an internal chamber 44 that is formed within the housing 12. Formed within the rear side 16 is a door 46. Door 46 includes a slidable latch 48. The door 46 is capable of being hinged about a hinge 50 relative to the remaining portion of the housing 12.

Figure 7B:
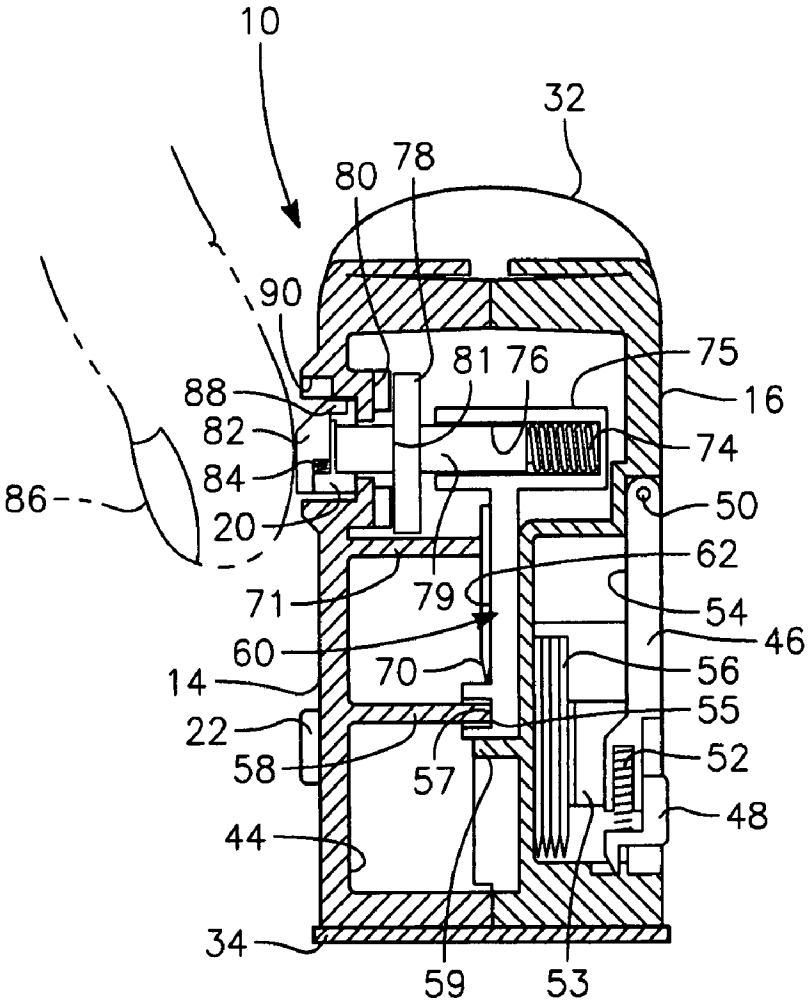
FIG. 7B is a view similar to FIG. 7A but showing the slidable actuator in an unlocked position.
Figure 7A:
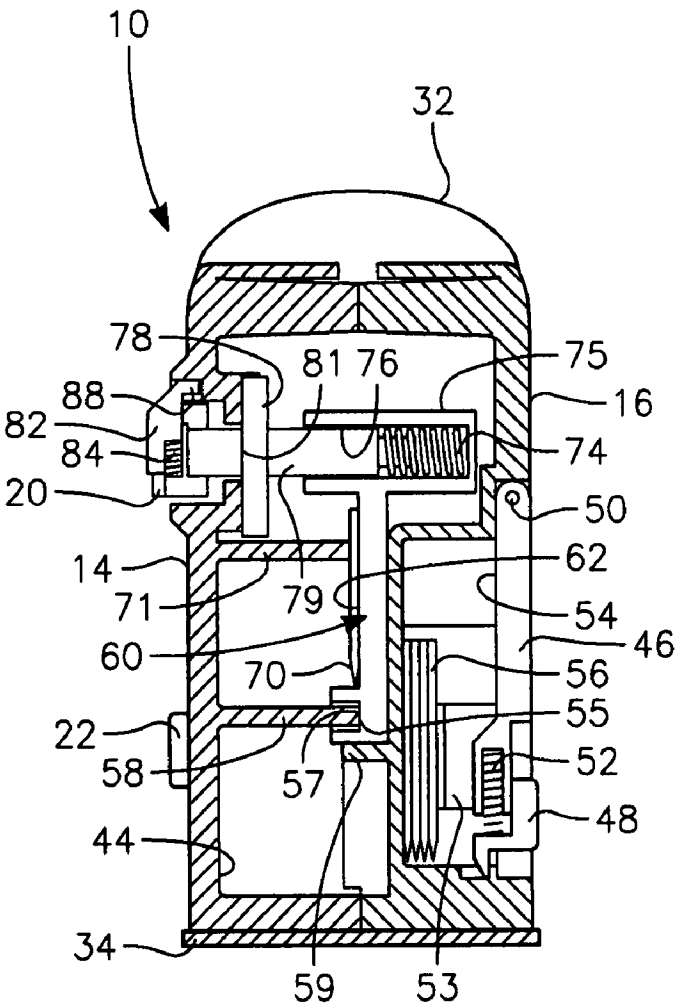
FIG. 7A is a transverse cross-sectional view taken along line 7A—7A of FIG. 1 showing the locking mechanism that is associated with the slidable actuator in a locked position.

Door 46 also includes a slidable latch 48. The latch 48 is biased by a coil spring 52. The coil spring 52 exerts a continuous bias against the latch 48 tending to locate the latch 48 in the locked position, which is shown in FIGS. 7A and 7B. Movement of the latch 48 against the bias of the coil spring 52 will disengage the latch 48 from the housing 12 and permit the door 46 to be opened gaining access to a blade storage chamber 54. There is to be mounted within the blade storage chamber 54 a plurality of cutting blades 56. The cutting blades 56 are deemed to be conventional and are commonly used in utility knives. The cutting blades 56 within the chamber 54 are located in a stacked configuration. There is a leaf spring 53 mounted on the inside surface of door 46. The bias of spring 53 functions to keep the blades 56 as a closed stack. There is shown four in number of the blades 56 located within the chamber 54, however this number could be increased or decreased within the scope of this invention.

Figure 8:
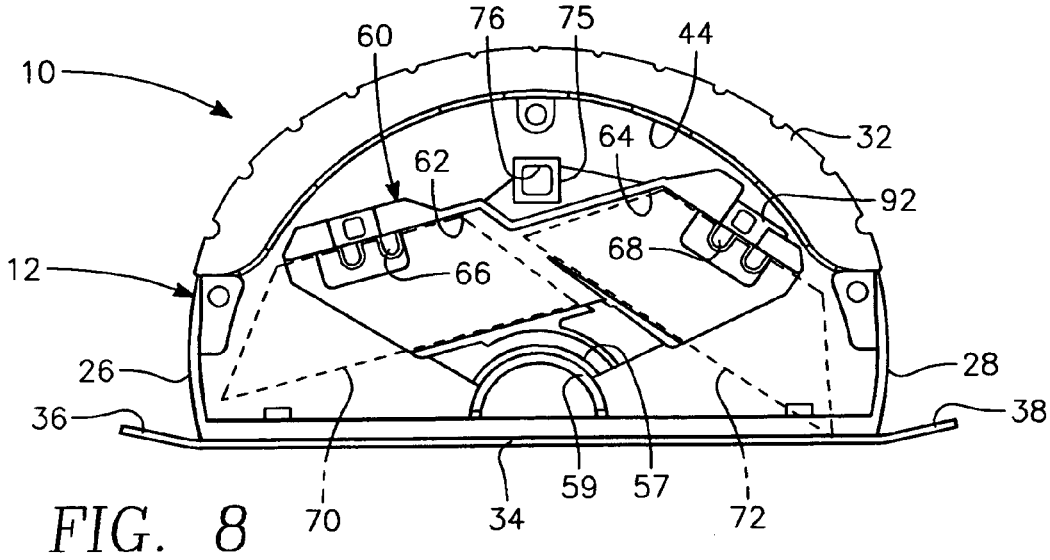
FIG. 8 is a longitudinal cross-sectional view clearly showing the blade holder that is utilized in conjunction with the utility knife of the present invention.

Mounted within the internal chamber 44 is a semicircular post 58. Post 58 is integral with front side 14. Post 58 has an internal free edge 55. Mounted within the internal chamber 44 is a blade holder 60. Blade holder 60 has an arcuate groove 57. Edge 55 is located in groove 57. Blade holder 60 rides on semicircular flange 59 which is concentric with edge 55. The blade holder 60 includes two separate indentations 62 and 64. Associated with indentation 62 is a pair of spaced apart knobs 66. A similar pair of knobs 68 is associated with the indentation 64. Each of the cutting blades 56 includes a pair of spaced apart notches. When a cutting blade 70 is mounted within indentation 62, the notches of that blade will connect with the knobs 66. When the cutting blade 72 is mounted within indentation 64, the notches of blade 72 will connect with the knobs 68, as is clearly shown in FIG. 8 of the drawings. The cutting blades 70 and 72 are identical to the cutting blades 56. Rib 71, which is integral to front side 14, functions to laterally restrain blades 70 and 72.

Slidable button 20 is centrally mounted on the blade holder 60. Slidable button 20 engages with a coil spring 74 mounted within a spring receiving chamber 76 that is formed within a spring housing 75. The housing 75 is actually part of the blade holder 60. Chamber 76 is square shaped.

Figure 5:
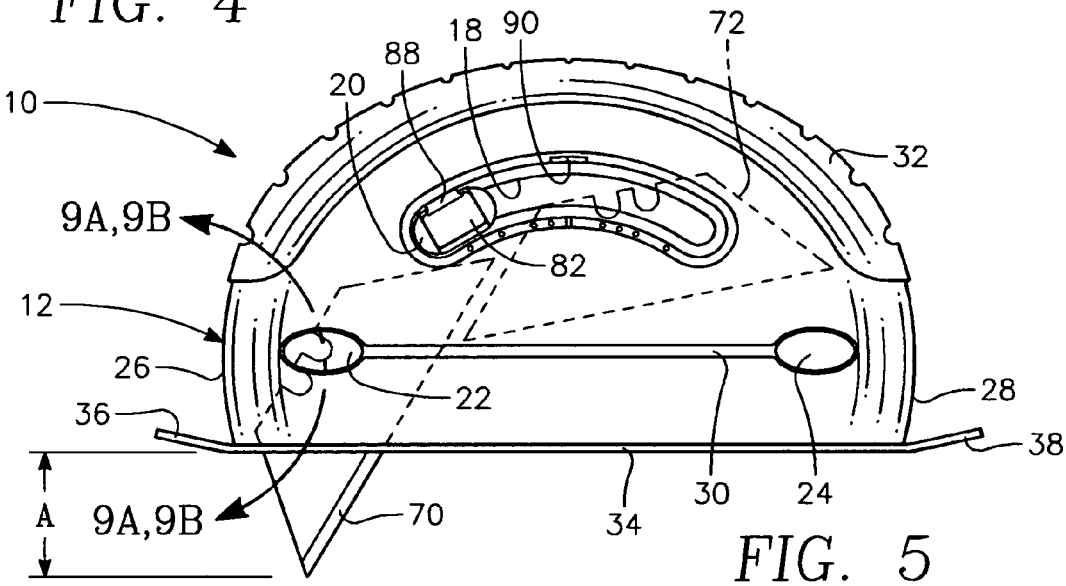
FIG. 5 is a front side elevational view similar to FIG. 1 but where one of the cutting blades is extended from the housing with this extension being at its maximum distance.
Figure 6:
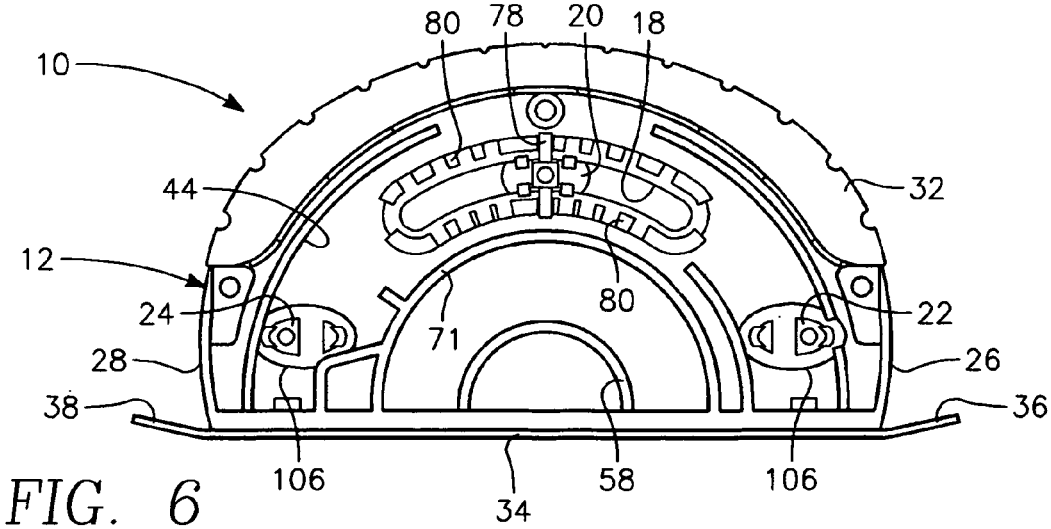
FIG. 6 is a longitudinal cross-sectional view through the housing of the utility knife of the present invention taken along line 6—6 of FIG. 2.

Fixedly mounted on the push button 20 is a pin 78. A spring retainer (square pin) 79 is internally mounted within push button 20. Pin 78 passes through a hole 81 formed in spring retainer 79. One end of coil spring 74 surrounds a portion of spring retainer 79. Spring retainer 79 closely conforms and slides within chamber 76. The surface surrounding the arcuate slot 18 within the internal chamber 44 includes a series of notches 80. Pushing inwardly on the push button 20 compressing the coil spring 74 will cause the pin 78 to disengage from one of the notches 80 which will then permit the push button 20 and the blade holder 60 to be pivoted. The limit of the pivoting action is determined by the length of the arcuate slot 18. When the push button 20 is released, the pin 78 will then reengage with another one of the notches 80. Each notch 80 will determine the distance that each cutting blade 70 and 72 will extend from the housing 12. The notch 80 that is located furthest to the left hand side of the slot 18 will fix the cutting blade 70 in its maximum extended position, which is about thirteen sixteenths of an inch, which is shown as distance A in FIG. 5. It is to be understood that with the push button in its right most position within the slot 18 that the cutting blade 72 will be similarly extended about thirteenth sixteenths of an inch. The cutting blade 72 will extend from the second slot 42 with the cutting blade 70 extending through the first slot 40. With the pin 78 located in a different notches 80, each cutting blade 70 or 72 could be extended at a lesser distance from the housing. When the push button 20 is in the precise dead center (intermediate) position or neutral position within the arcuate slot 18, neither cutting blade 70 or 72 will be extended from the housing 12. The cutting blades 70 and 72 at this time will be confined to the internal chamber 44.

To inform the user of this intermediate or neutral position of the push button 20, there is mounted on the exterior surface of the push button 20 a latch plate 82. The latch plate 82 is movable up and down on the push button 20 against the bias of a coil spring 84. For the user taking his or her finger 86 and pushing downwardly on the latch plate 82, the latching pawl 88 of the latch plate 82 will disengage from a notch 90 formed on the exterior surface of the housing 12 directly adjacent the arcuate slot 18. The notch 90 is actually located at precisely the midpoint of the slot 18. The purpose of the latch plate 82 is to inform the user of the neutral or intermediate position so that if the user determines that the latching pawl is engaged with the notch 90 the user knows that the outer tips of the blades 70 and 72 are not extending even the slightest amount from the housing 12. This latch plate 82 is provided for the purpose of hopefully preventing any accidental injury to any person by inadvertent extension of the cutting blades 70 and 72 from the housing 12.

Figure 9A:
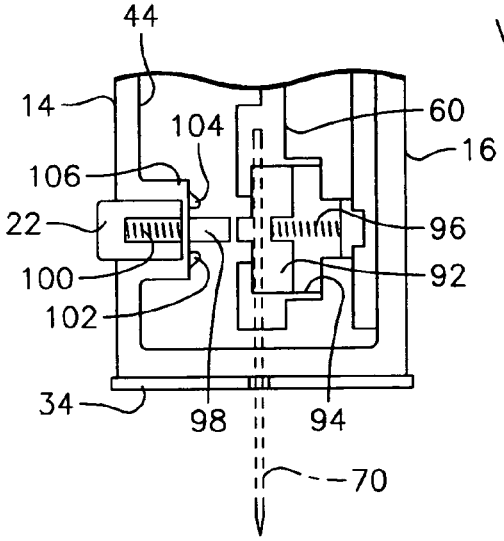
FIG. 9A is a cross-sectional view taken through line 9A—9A of FIG. 5 showing the blade release mechanism in its position which locks the cutting blade to the housing.
Figure 9B:
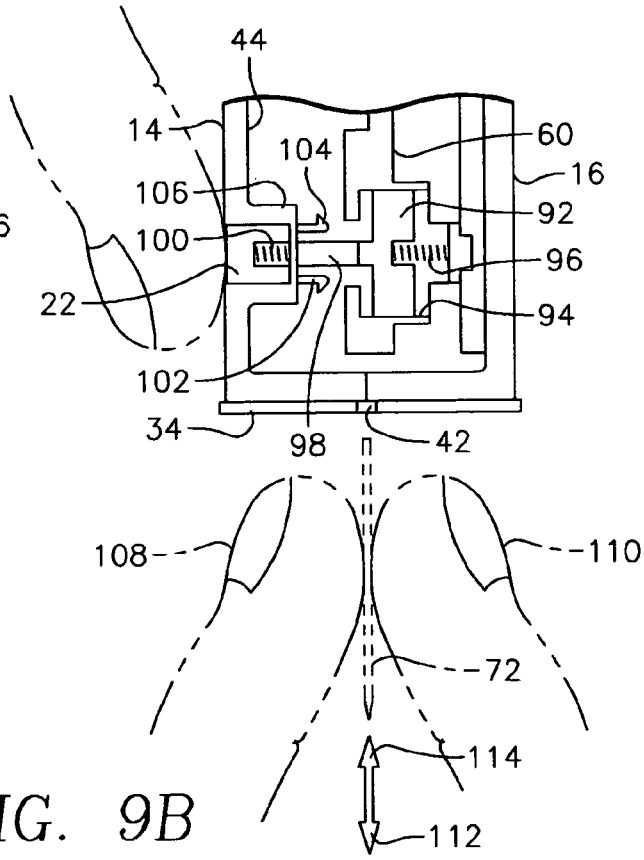
FIG. 9B is a view similar to FIG. 9A that is taken also in the direction of line 9B—9B of FIG. 5 that shows the blade release mechanism in its position which permits release of the cutting blade in order to permit installing of a new blade in conjunction with the utility knife.

Associated with each button 22 and 24 is a blade release mechanism, which is shown in FIGS. 9A and 9B. This blade release mechanism includes a block 92 that is mounted within a block chamber 94. The block 92 is slidable within the chamber 94 a limited distance. Mounted also within the chamber 94 is a coil spring 96. A block 92 is to be contactable by button extension 98. The button extension 98 works against a coil spring 100 mounted interiorly of the push button 22. Push button 22 has a pair of inwardly extending hooks 102 and 104. When the hooks 102 and 104 engage with boss 106 which is integral with the housing 12, the outward position of the button 22 is established. Pushing against the button 22 will cause springs 100 and 96 to both be compressed and cause the block 92 to move within the block chamber 94. This will cause the blade 70 or 72 to be disengageable from the housing 12 by the human user grasping the blade, as shown by the fingers 108 and 110 in FIG. 9B and pulling outward on the blade in the direction of arrow 112. The user is to then discard the blade 72, obtain a new cutting blade from the stack of blades 56 and then reinsert such in the direction of arrow 114 while still holding down on the push button 22. This insertion is to be until the notches on the cutting blade connect with the knob 66 and then the push button 22 is to be released. It is to be understood that the operation of the push button 24 is to be in the same manner.

The footplate 34 has a short longitudinal notch 116 formed within the upturned end 36 and a short upturned notch 118 formed within the upturned end 38. These notches 116 and 118 are to facilitate alignment of the utility knife 10 in conjunction with the workpiece, which is not shown. Usually there would be an inscribed line on the workpiece and the notches 116 and 118 are to be aligned with that notch which will inform the user that the cutting blades 70 and 72 are to cut on that inscribed line.

It is to be understood that when cutting blade 70 is extended, the user uses the utility knife by pulling such toward him or her on the workpiece. When the cutting blade 72 is extended, the utility knife 10 is to be used in a pushing action pushing the utility knife away from the user. It is to be understood that either cutting blade 70 or cutting blade 72 is extended but not at the same time.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A utility knife comprising:

a substantially semi-circular housing having a top portion, two side portions, a front portion, a rear portion, and an internal chamber, said housing further having a footplate having a fore end and an aft end, said footplate having a longitudinal axis bisecting said footplate and running from the fore to aft end, and a transverse axis bisecting said footplate and running from the front to rear portion, and being perpendicular to the longitudinal axis, a first slot and a second slot formed in said footplate, said first slot located directly adjacent said fore end, said second slot located directly adjacent said aft end, both said first slot and said second slot being located along the longitudinal axis of said footplate of said housing, thereby allowing said footplate to be adapted to be placed against a workpiece that is to be cut;

a blade holder mounted within said internal chamber said internal chamber being capable of housing a plurality of blades, said blade holder being pivotable relative to said housing between a fore position and an aft position;

a first blade and a second blade mounted on said blade holder, with said blade holder in said fore position said first blade extending exteriorly of said internal chamber through said first slot located along the longitudinal axis of said footplate of said housing, with said blade holder in said aft position said second blade extending exteriorly of said internal chamber through said second slot located along the longitudinal axis of said footplate of said housing;

an actuator connected to said blade holder on said front end of said housing, said actuator extending exteriorly of said housing, said actuator contactable manually to cause movement of said blade holder between said fore position and said aft position;

an entry means located on said rear portion of said housing for access to said plurality of housed blades; and a pair of push buttons located on said front portion of said housing said pair of push buttons being equipped with blade release mechanisms.

2. The utility knife as defined in claim 1 wherein said footplate is substantially planar and has slightly upturned ends on said fore and aft ends of said footplate.

3. The utility knife as defined in claim 1 wherein said housing includes a centrally located semicircular post which is located within said internal chamber, said blade holder to pivot about said post.

4. The utility knife as defined in claim 1 wherein said blade holder is capable of being located in an intermediate (neutral) position which is located midway between said fore position and said aft position, with said blade holder in said intermediate (neutral) position neither of said blades extend exteriorly of said housing.

5. The utility knife as defined in claim 1 wherein said actuator further comprises a slidable button.

6. The utility knife as defined in claim 1 wherein said actuator is lockable in any one of a plurality of different positions.

7. The utility knife as defined in claim 1 wherein the blade release mechanisms are mounted on said housing, and each mechanism cooperates with a respective one of said pair of push buttons, said blade release mechanism being activatable via said push buttons to cause each of said blades to be disengaged from said housing in order to permit replacement with respective new blades.

8. The utility knife as defined in claim 7 wherein an actuator accessible for manual operation relative to said housing, said actuator extending exteriorly of said housing, movement of said actuator causing said blade holder to be pivoted.

9. The utility knife as defined in claim 8 wherein said actuator includes a latch plate, said latch plate to engage only when said actuator is in a neutral or intermediate position where neither blade of said blades is extended from said housing.

10. The utility knife as defined in claim 7 wherein only one blade of said blades is to be extended at a time.

11. The utility knife as defined in claim 7 wherein said blade holder is pivotally movable relative to said housing between a fore position that will cause one of said blades to be extended and an aft position that will cause another blade of said blades to be extended.

12. The utility knife as defined in claim 7 wherein said blade holder can be located in an intermediate (neutral) position where no blade is extended.

13. The utility knife as defined in claim 7 wherein said blade holder is lockable in any one of a plurality of different positions.

14. The utility knife as defined in claim 1 wherein said actuator includes a latch plate, said latch plate to be engaged only when said actuator is in an intermediate (neutral) position where neither said first blade nor said second blade is extended from said housing.

* * * * *